US010253940B1

(12) United States Patent
Shih

(10) Patent No.: US 10,253,940 B1
(45) Date of Patent: Apr. 9, 2019

(54) VEHICLE LIGHT ASSEMBLY

(71) Applicant: T.Y.C. BROTHER INDUSTRIAL CO., LTD., Tainan (TW)

(72) Inventor: Ming-Chih Shih, Tainan (TW)

(73) Assignee: T.Y.C. BROTHER INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 15/920,560

(22) Filed: Mar. 14, 2018

(51) Int. Cl.

| | |
|---|---|
| ***F21V 5/04*** | (2006.01) |
| ***F21S 41/36*** | (2018.01) |
| ***F21S 41/663*** | (2018.01) |
| ***F21V 7/06*** | (2006.01) |
| ***F21S 41/20*** | (2018.01) |

(52) U.S. Cl.
CPC ..... *F21S 41/36* (2018.01); *F21S 41/285* (2018.01); *F21S 41/663* (2018.01); *F21V 7/06* (2013.01)

(58) Field of Classification Search
CPC .. F21S 41/20; F21S 41/24; F21S 41/25; F21S 41/255; F21S 41/256; F21S 41/26; F21S 41/265; F21S 41/27; F21S 41/275; F21S 41/285
USPC ..... 362/520–522
See application file for complete search history.

(56) References Cited

U.S. PATENT DOCUMENTS

| | | | | |
|---|---|---|---|---|
| 8,579,472 | B2 * | 11/2013 | Koizumi | F21V 5/04 362/308 |
| 2012/0033441 | A1 * | 2/2012 | Sousek | F21S 48/215 362/555 |
| 2015/0241616 | A1 * | 8/2015 | Bungenstock | G02B 6/0021 362/511 |
| 2017/0030542 | A1 * | 2/2017 | Gromfeld | F21S 48/1241 |

* cited by examiner

*Primary Examiner* — Sean P Gramling
*Assistant Examiner* — Keith G. Delahoussaye
(74) *Attorney, Agent, or Firm* — Burris Law, PLLC

(57) ABSTRACT

A lens of a vehicle light assembly includes a front curved light exit surface, a rear light entry surface spaced apart from the curved light exit surface along an optical axis and convexed rearwardly, left and right reflection surfaces connected to the light entry surface, and left and right flank surfaces connected to the left and right reflection surfaces and to the curved light exit surface. A minimum distance of each flank surface from the optical axis is greater than a maximum distance of each reflection surface from the optical axis.

11 Claims, 11 Drawing Sheets

VEHICLE LIGHT ASSEMBLY

FIELD

The disclosure relates to a light assembly, and more particularly to a vehicle light assembly.

BACKGROUND

As shown in FIGS. 1 and 2, a vehicle light assembly, disclosed in Taiwanese Patent No. 1582335, includes a light emitter module 1 and a heat dissipation member 2. The light emitter module 1 includes a lens 11 and a light emitter 12. The lens 1 has a light entry surface 111, a light exit surface 112 spaced apart from the light entry surface 111 along an optical axis (L), and two opposite flank surfaces 113 connecting the light entry surface 111 to the light exit surface 112 along the optical axis (L).

The light emitter 12 emits light rays into the lens 11 through the light entry surface 111. Some light rays (A) (see arrow A in FIG. 2), which beam forwardly and exit from the light exit surface 112, are concentrated to a central area in front of the vehicle light assembly. Some light rays (B) (see arrow B in FIG. 2) are transmitted forwardly by multiple reflections between the flank surfaces 113 to exit from the light exit surface 112. The light rays (B), which are reflected from a left one of the flank surfaces 113 to the light exit surface 112, are emitted forward and rightward from the light exit surface 112 after exiting the light exit surface 112. The light rays (B), which are reflected from a right one of the flank surfaces 113 to the light exit surface 112, are emitted forward and leftward from the light exit surface 112 after exiting the light exit surface 112.

In practice, it is found that the light rays (A) and (B) project a non-continuous light pattern on an illuminated plane which forms three discrete bright regions. Because dark regions appear between adjacent bright regions, the non-continuous light pattern is unable to provide satisfactory visual effects. Furthermore, because the flank surfaces 113 are essentially utilized for light reflection, the light pattern provided by the vehicle light assembly is significantly affected by the flank surfaces 113. Hence, it is impossible to vary greatly the profile and curvature of the flank surfaces 113 for improving design varieties.

SUMMARY

Therefore, an object of the disclosure is to provide a vehicle light assembly that can alleviate at least one of the drawbacks of the prior art.

According to the disclosure, a vehicle light assembly includes at least one light emitter module. The at least one light emitter module includes a lens and a light emitter disposed at a rear side of the lens. The lens includes a curved light exit surface, a light entry surface, left and right reflection surfaces, and left and right flank surfaces.

The curved light exit surface is disposed at a front side of the lens.

The light entry surface is spaced apart from the light exit surface along an optical axis (L) and disposed adjacent to the light emitter. The light entry surface has a first light entry portion through which the optical axis (L) passes. The first light entry portion is convexed rearwardly in a direction away from the curved light exit surface.

The left and right reflection surfaces are respectively connected to left and right sides of the light entry surface to reflect light of the light emitter passing through the light entry surface to the curved light exit surface. Each of the left and right reflection surfaces is a parabolic surface and has a virtual focal point that is disposed at a distance from the entry surface more longer than a distance of the light emitter from the entry surface and that is offset from the optical axis.

The left and right flank surfaces are respectively disposed at a left side of the left reflection surface and a right side of the right reflection surface, and extend forwardly to connect the curved light exit surface. Each of the left and right flank surfaces has a minimum distance from the optical axis. Each of the left and right reflection surfaces has a maximum distance from the optical axis. The minimum distance of each of the left and right flank surfaces is greater than the maximum distance of each of the left and right reflection surfaces.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
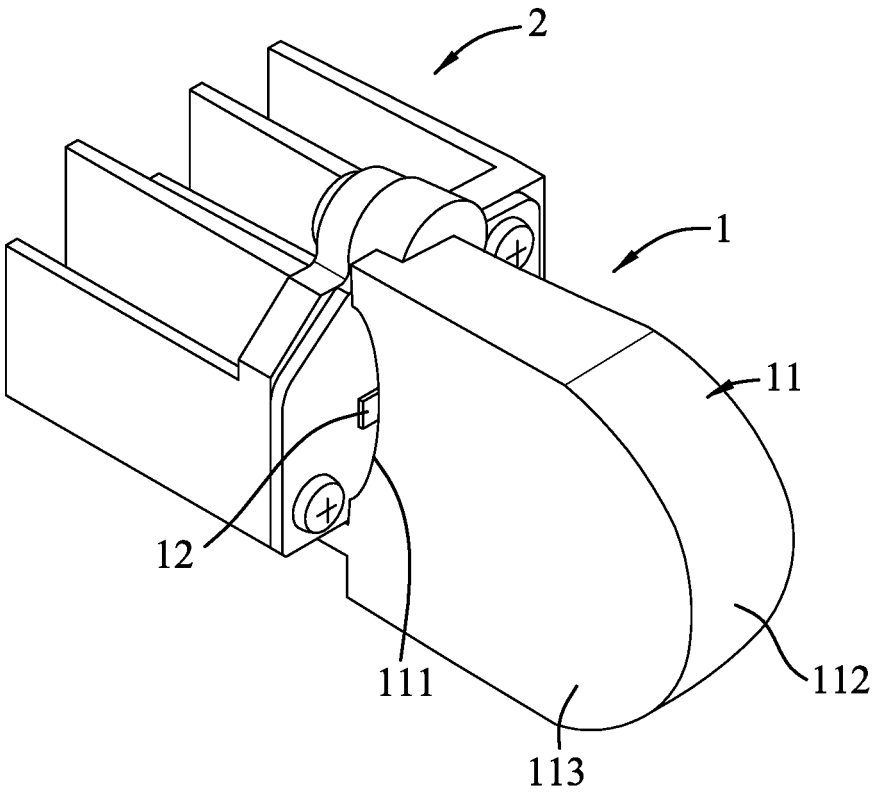
FIG.1 PRIOR ART
FIG. 1 is a perspective view of an existing vehicle light assembly.
Figure 2:
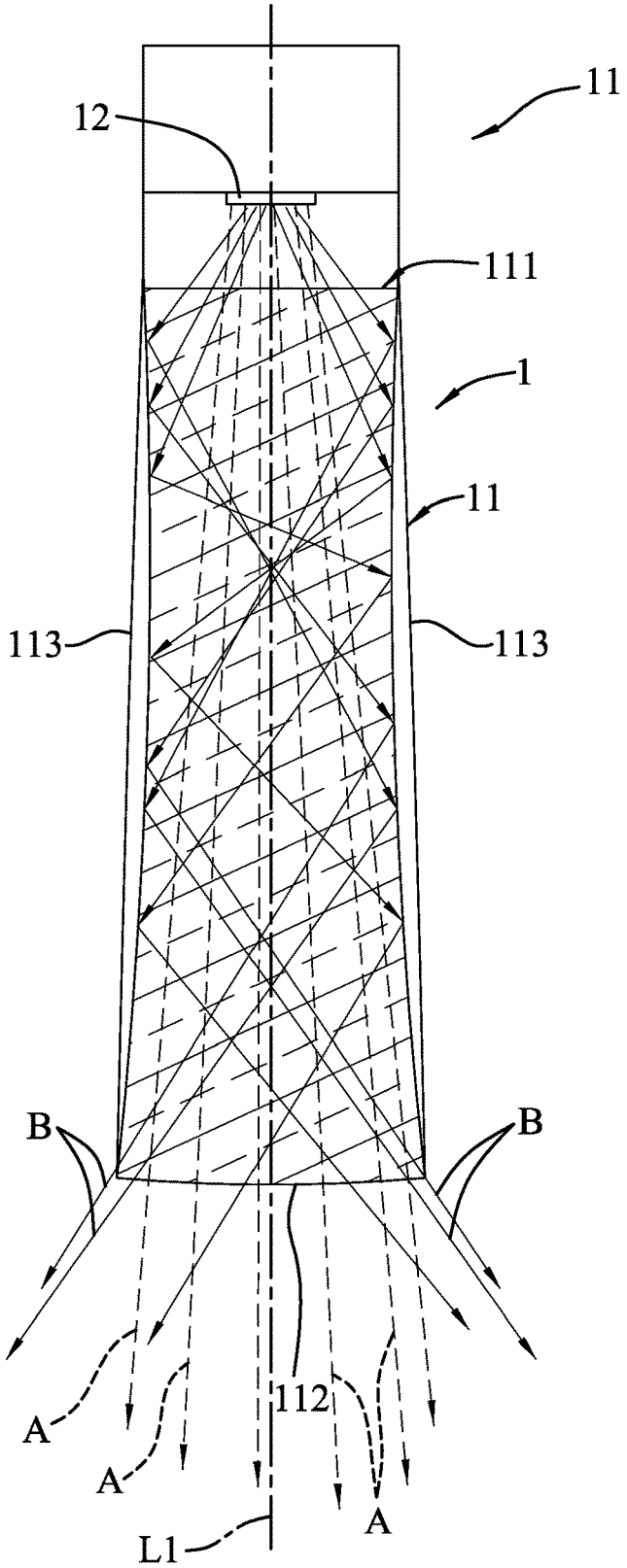
FIG.2 PRIOR ART
FIG. 2 is a top sectional view of the existing vehicle light assembly.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 3 to 6, a vehicle light assembly according to a first embodiment of the present disclosure includes a light emitter module 3. The light emitter module 3 includes a lens 4, a light emitter 5 disposed at a rear side of the lens 4, and a circuit board 51.

The lens 4 includes a curved light exit surface 42 disposed at a front side of the lens 4, a light entry surface 41, left and right reflection surfaces 43, left and right bridge surfaces 44, and left and right flank surfaces 45.

The light entry surface 41 is spaced apart from the curved light exit surface 42 along an optical axis (L), and is disposed adjacent to the light emitter 5. The light entry surface 41 has a first light entry portion 411, abase portion 410, and a second light entry portion 412. The optical axis (L) passes through the first light entry portion 411. The first light entry portion 411 is convexed rearwardly in a direction away from the curved light exit surface 42. The base portion 410 is flat and disposed around the optical axis (L) rearwardly of the first light entry portion 411. The second light entry portion 412 is disposed annularly around the optical axis (L) and is connected between an annular inner periphery of the base portion 410 and the first light entry portion 411. The first and second light entry portions 411, 412 cooperatively bound a light entry hole 413. The light entry hole 413 has an opening 414 that faces rearward and that is formed in the base portion 410. In other words, the light entry hole 413 is immediately disposed at the front of the light emitter 5, and the first light entry portion (411) is immediately disposed at the front of the light entry hole 413. The first light entry portion 411 is convexed rearwardly into the light entry hole 413. The base portion 410 is close to the light emitter 5.

Figure 3:
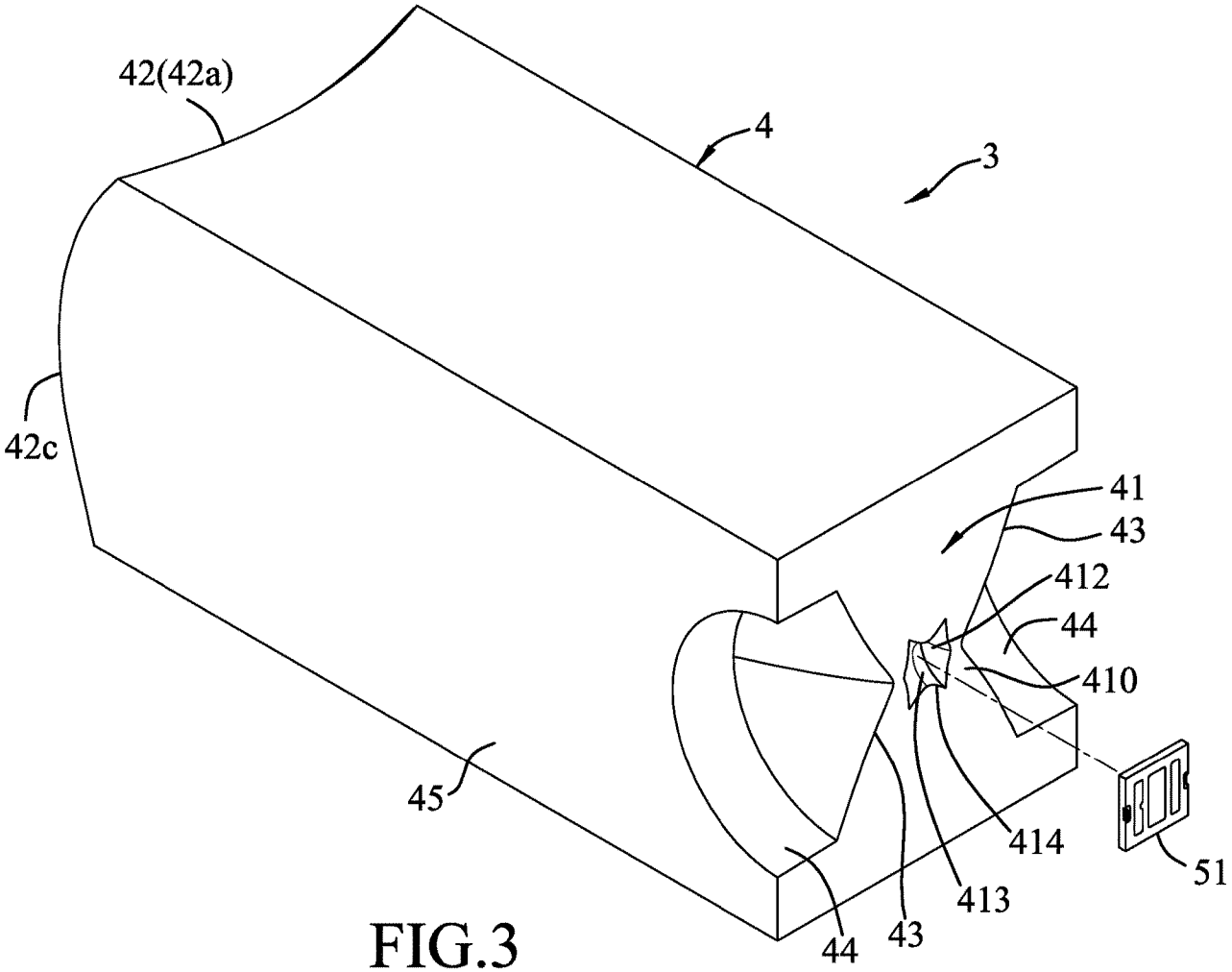
FIG. 3 is a rear perspective view of a vehicle light assembly according to a first embodiment of the present disclosure.
Figure 4:
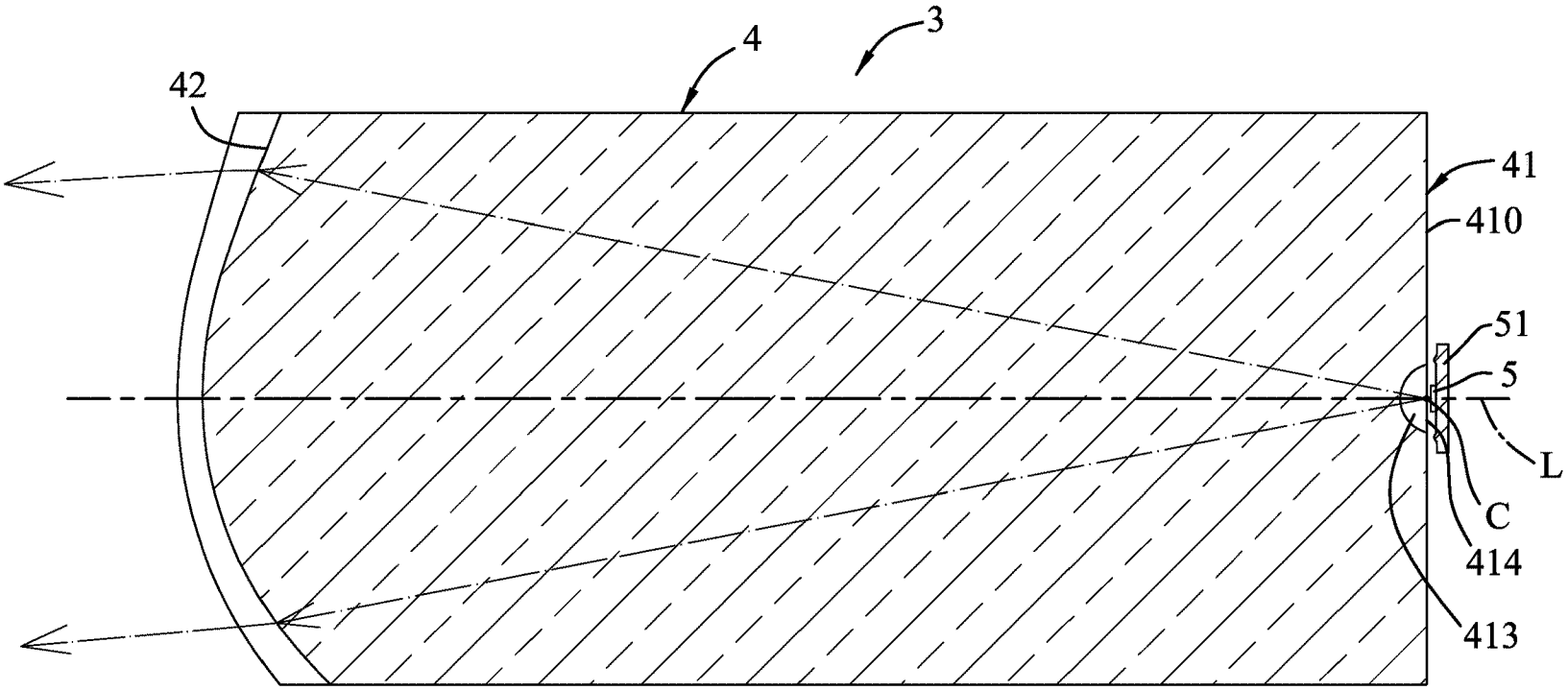
FIG. 4 is a side sectional view of the first embodiment functioning as a high beam light bulb.
Figure 5:
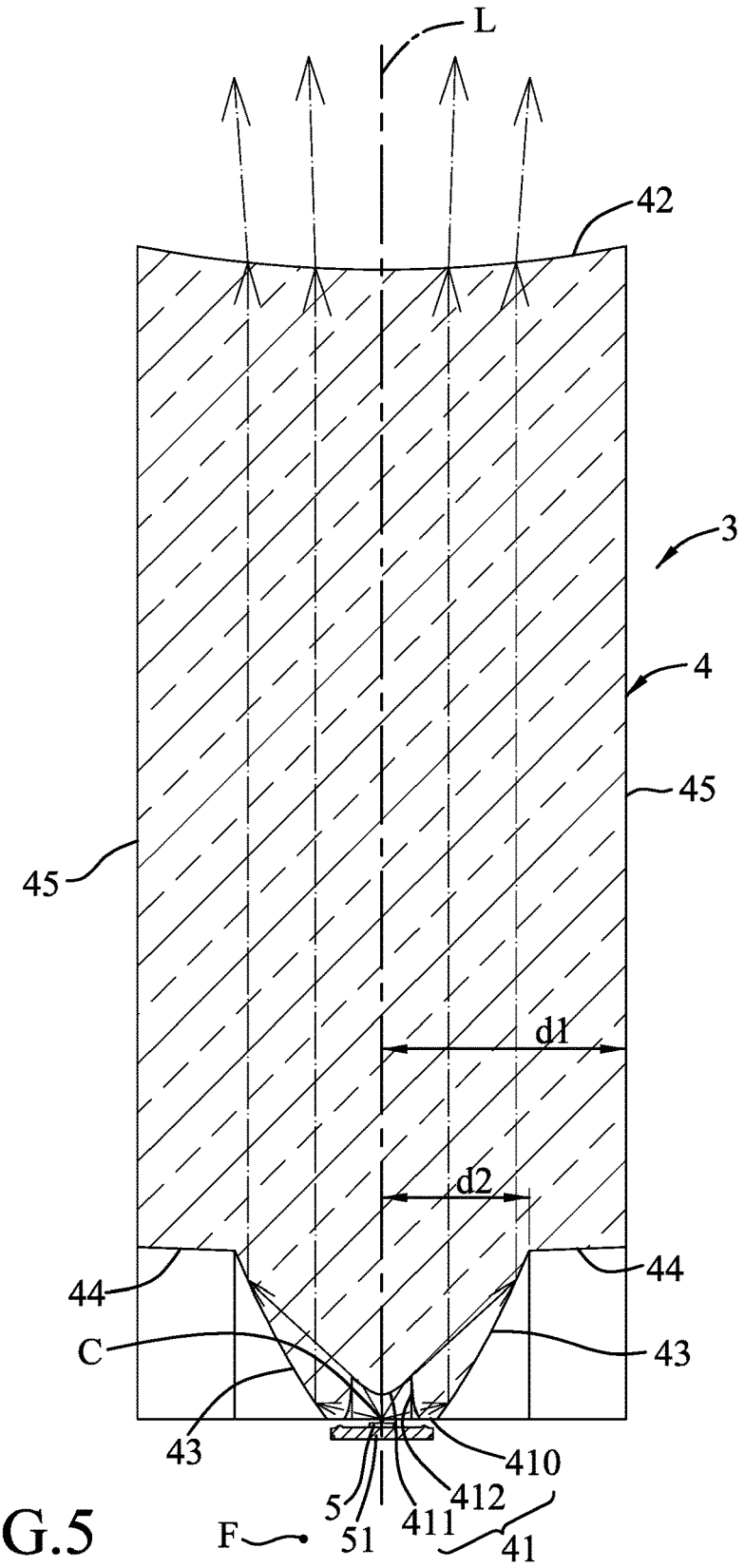
FIG. 5 is a top sectional view of the first embodiment.
Figure 6:
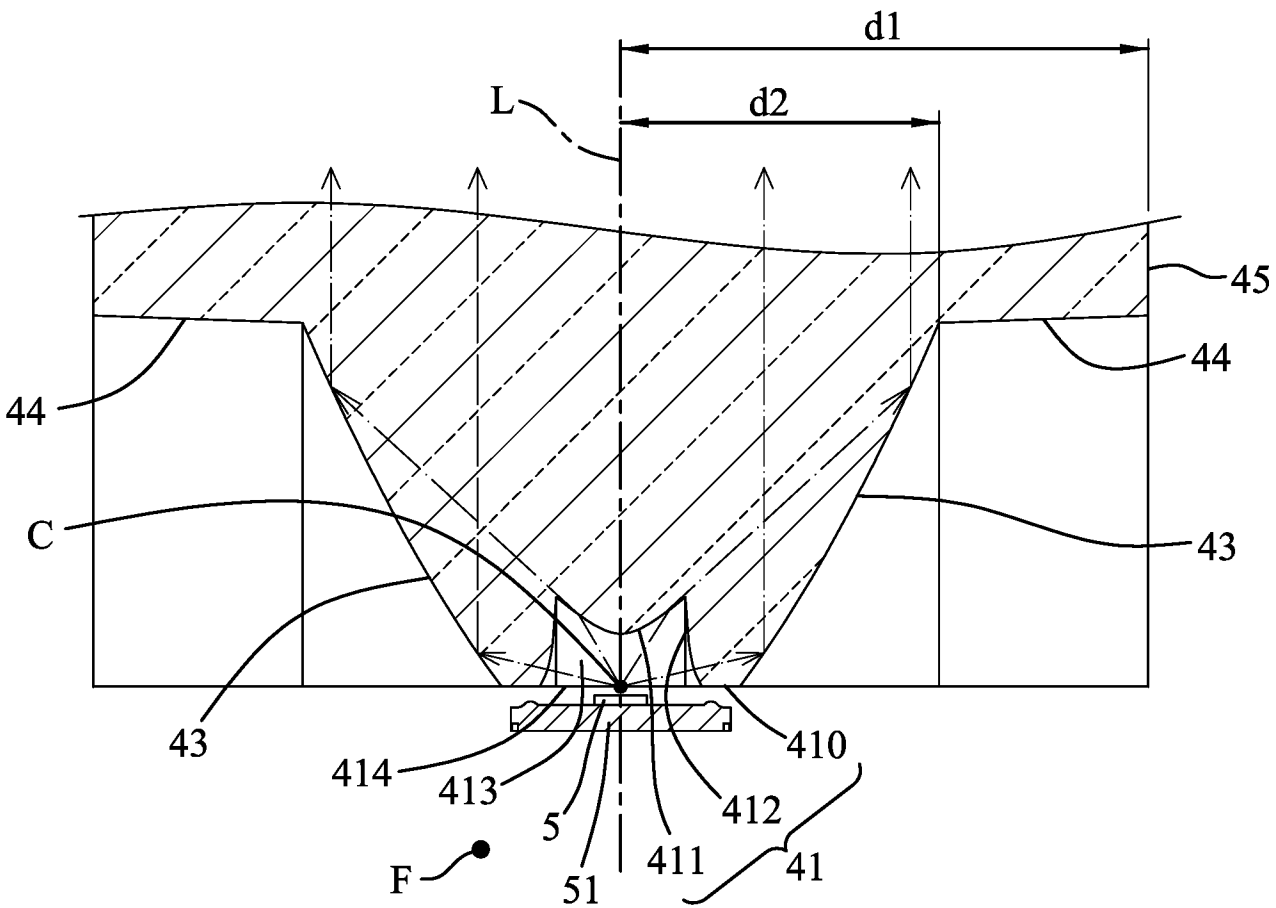
FIG. 6 is an enlarged fragmentary sectional view of the first embodiment.
Figure 8:
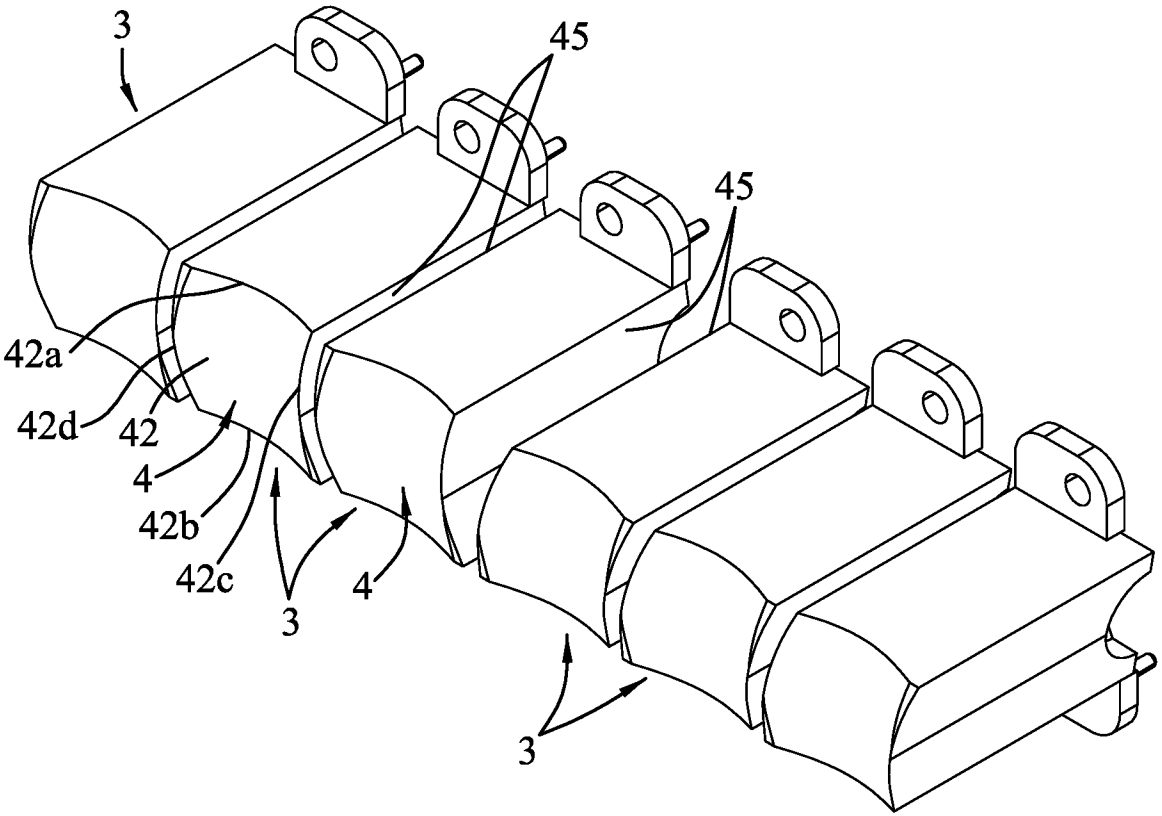
FIG. 8 is a front perspective view of a vehicle light assembly according to a second embodiment.

The curved light exit surface 42 has an exit surface top side 42*a*, an exit surface bottom side 42*b*, an exit surface left side 42*c*, and an exit surface right side 42*d* (see FIGS. 3 and 8). The curved light exit surface 42 protrudes arcuately and forwardly from the exit surface top and bottom sides 42*a*, 42*b* to a region disposed midway between the exit surface top and bottom sides 42*a*, 42*b* so that the exiting light rays can be directed forward and downward. Further, the curved light exit surface 42 indents rearwardly and arcuately from the exit surface left and right sides 42*c*, 42*d* to a region disposed midway between the exit surface left and right sides 42*c*, 42*d* so that the exiting light rays slant slightly leftward and rightward to increase the range of illumination in a left-right direction. By virtue of the particular profile and curvature of the curved light exit surface 42, it is possible to effectively control an illuminated area.

The left and right reflection surfaces 43 are respectively connected to left and right sides of the light entry surface 41 to reflect light rays of the light emitter 5 incident on the light entry surface 41 toward the curved light exit surface 42. Particularly, the left and right reflection surfaces 43 are respectively connected to left and right sides of the base portion 410. Each of left and right reflection surfaces 43 is a parabolic surface. The left or right reflection surface 43 should not be large. The length of the left or right reflection surface 43 ina front-rear direction is shorter than that of the left or right flank surface 45.

The left and right bridge surfaces 44 respectively extend leftward and rightward from the left and right reflection surfaces 43 and connect rear ends of the left and right flank surfaces 45.

The left and right flank surfaces 45 are respectively disposed at the left side of the left reflection surface 43 and the right side of the right reflection surface 43 and extend forwardly from the respective left and right bridge surfaces 44 to connect the curved light exit surface 42. A distance (d1) of each of the left and right flank surfaces 45 from the optical axis (L) is greater than a maximum distance (d2) of each of the left and right reflection surfaces 43 from the optical axis (L).

Figure 7:
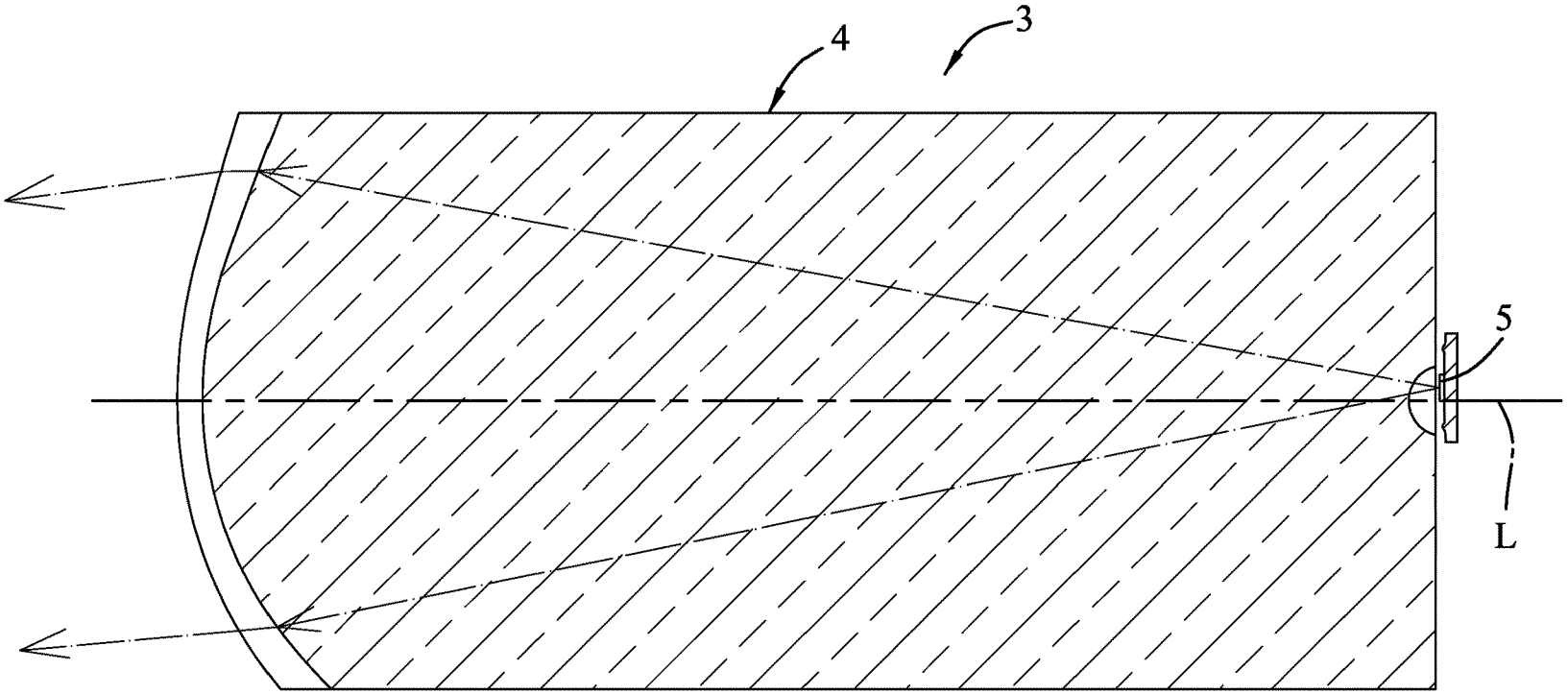
FIG. 7 is a side sectional view of the first embodiment functioning as a low beam light bulb.

The light emitter 5, such as an LED, is mounted on the circuit board 51, and both of them are located rearward of the base portion 410 of the light entry surface 41. The light emitter 5 faces the first light entry portion 411 and the opening 414 of the light entry hole 413. In this embodiment, the light emitter 5 has a center located at the optical axis (L), and the light emitter module 3 functions as a high beam light bulb. Referring to FIG. 7, when an edge of the light emitter 5 is located at the optical axis (L), the light emitter module 3 functions as a low beam light bulb. By orienting the light emitter 5 differently with respect to the optical axis (L), the light emitter module 3 is capable of providing different illumination functions.

Referring back to the FIGS. 4 to 6, when the light rays of the light emitter 5 enter the lens 4 through the first and second light entry portions 411, 412 of the light entry surface 41, the first light entry portion 411, which protrudes rearward, facilitates converging of the light rays after refraction. The left and right reflection surfaces 43 reflect the light rays to be closer to the optical axis (L) rather than toward the left and right flank surfaces 45. Afterwards, the light rays exit the curved light exit surface 42. The left reflection surface 43 reflects the light rays toward the curved light exit surface 42 at the left side of the optical axis (L). The right reflection surface 43 reflects the light rays to the curved light exit surface 42 at the right side of the optical axis (L). By virtue of the particular curvature and profile of the curved light exit surface 42, the curved light exit surface 42 can generate an illumination area sufficiently large to provide a light distribution pattern and brightness required by vehicle lighting regulations. Because the vehicle light assembly of the present disclosure can enable the exiting light rays to provide uniformly and continuously distributed lighting regions, occurrence of dark regions that interrupt or discontinue the light distribution pattern can be avoided. In addition, because the light rays of the light emitter 5 are reflected by the left and right reflection surfaces 43, the light rays almost do not travel to the left and right flank surfaces 45. Therefore, the left and right flank surfaces 45 are not main functional surfaces for reflecting the light rays and controlling the light distribution pattern. Accordingly, the left and right flank surfaces 45 may be provided with other design varieties, such as different extension directions, different curvatures, different slopes, different embossed patterns, etc., without affecting the desired light distribution pattern.

Referring back to FIGS. 5 and 6, the left and right reflection surfaces 43 are parabolic surfaces having respective virtual focal points (F) disposed at a same location that has a distance from the entry surface 41 more longer than a distance of the light emitter 5 from the entry surface 41 and that is offset from the optical axis (L). The virtual focal point (F) is at the rear side of the light emitter 5. Experiments showed that the aforesaid design can provide considerably high illumination efficiency and brightness. If the virtual focal point (F) of the left and right reflection surfaces 43 falls to the location of the light emitter 5, or between the first light entry portion 411 of the light entry surface 41 and the light emitter 5 (i.e., at the front side of the light emitter 5), in order to achieve the desired optical effects, the light entry surface 41 will have to be located more forwardly and the curved light exit surface 42 will have to be adjusted and shifted forwardly. That is to say, the lens 4 will need an increased front-rear length (i.e., an increased distance between the base portion 410 and the curved light exit surface 42), which is not beneficial for miniaturization of the lens 4. According to the vehicle light assembly of the present disclosure, because the virtual focal point (F) of the left and right reflection surfaces 43 is offset from the optical axis (L) and disposed at the distance from the entry surface 41 more longer than the distance of the light emitter 5 from the entry surface 41, the front-rear length of the lens 4 can be shortened for minimizing the lens 4. Further, the optical axis (L) intersects the opening 414 at an intersection point (C). Optimally, the first light entry portion 411 of the light entry surface 41 has a focal point located at the intersection point (C). The curved light exit surface 42 has a focal point located at the intersection point (C) or located in vicinity of the intersection point (C).

Referring to FIG. 8, a vehicle light assembly according to a second embodiment of the present disclosure includes a plurality of the light emitter modules 3 juxtaposed to each other. One of the left and right flank surfaces 45 of each of the juxtaposed light emitter modules 3 faces one of left and right the flank surfaces 45 of the other one of the juxtaposed light emitter modules 3. In this embodiment, the light emitter modules 3 are, but not limited to, juxtaposed to each other in a row. Every two adjacent light emitter modules 3 may be spaced apart from each other, or may adjoin each other. Further, at least one of the light emitter modules 3 functions as a high beam light bulb, and at least one of the light emitter modules 3 functions as a low beam light bulb. Therefore, the vehicle light assembly of the present disclosure can be controlled to provide the low beam function or high beam function. In other embodiments, all of the light emitter modules 3 may function as high or low beam light bulbs.

On the other hand, because the left and right flank surfaces 45 of each lens 4 are not essential components for controlling the light distribution pattern, the lenses 4 of the light emitter modules 3 can be juxtaposed to each other by adjoining the left and right flank surfaces 45 of every two adjacent ones of the lenses 4. By combining the light emitter modules 3 in different ways, it is possible to not only provide various unique and aesthetically pleasing appearances, but also allow the vehicle light assembly to match suitably with different installation spaces and to function differently as high or low beam light bulbs.

Figure 9:
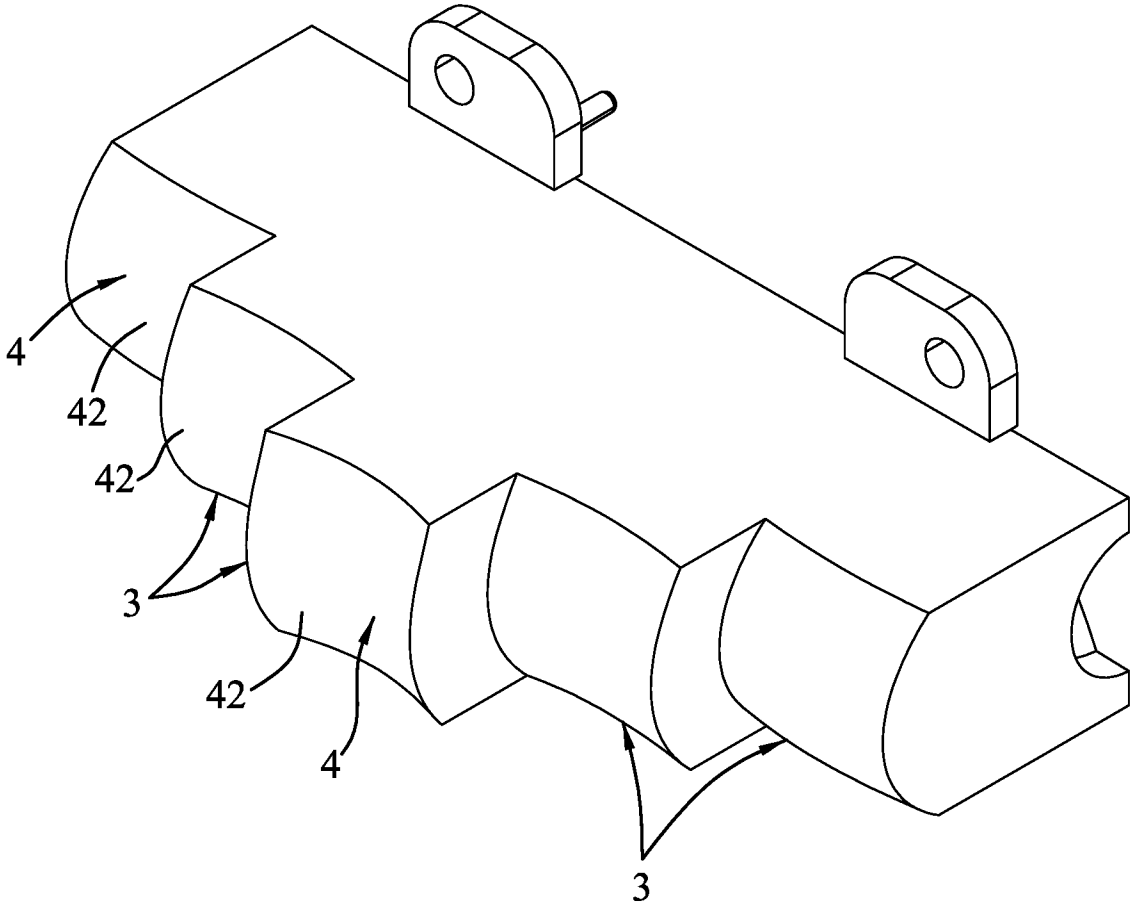
FIG. 9 is a front perspective view of a vehicle light assembly according to a third embodiment of the present disclosure.
Figure 10:
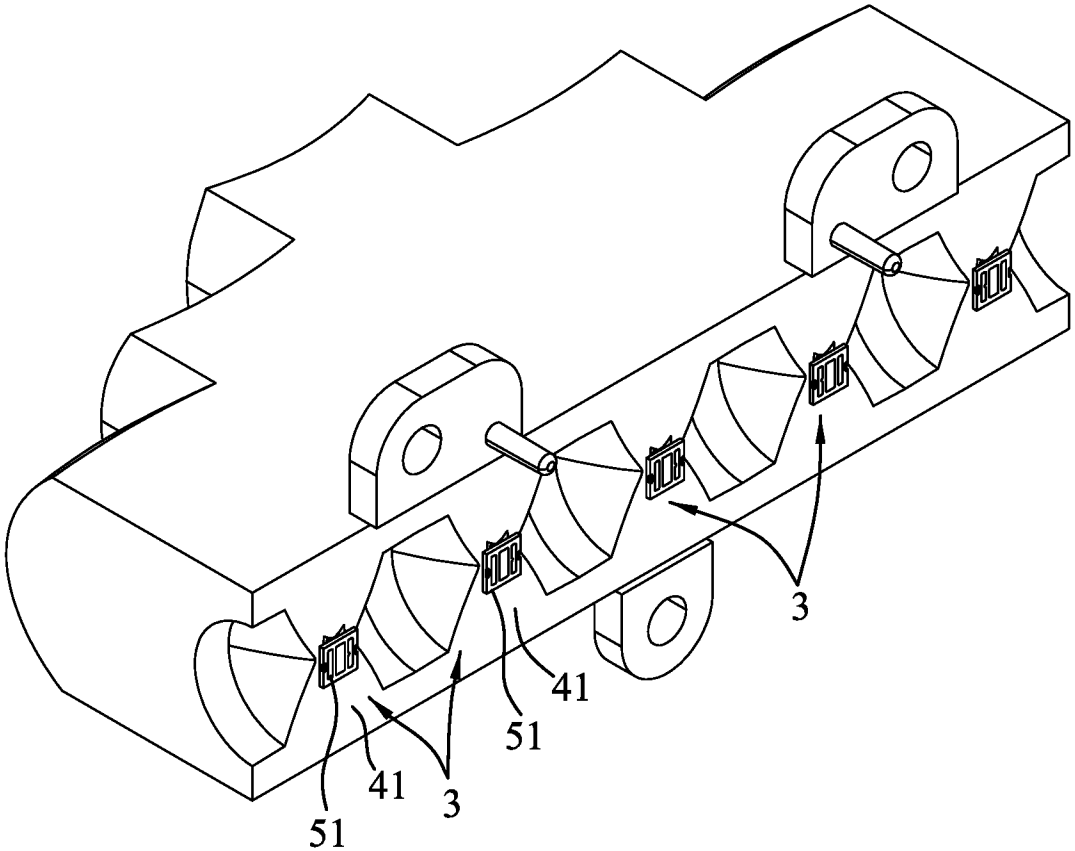
FIG. 10 is a rear perspective view of the third embodiment.

Referring to FIGS. 9 and 10, a vehicle light assembly according to a third embodiment of the present disclosure includes a plurality of the light emitter modules 3 juxtaposed to each other along a line and are integrally formed as one piece. The front-rear lengths of the light emitter modules 3 are different.

Figure 11:
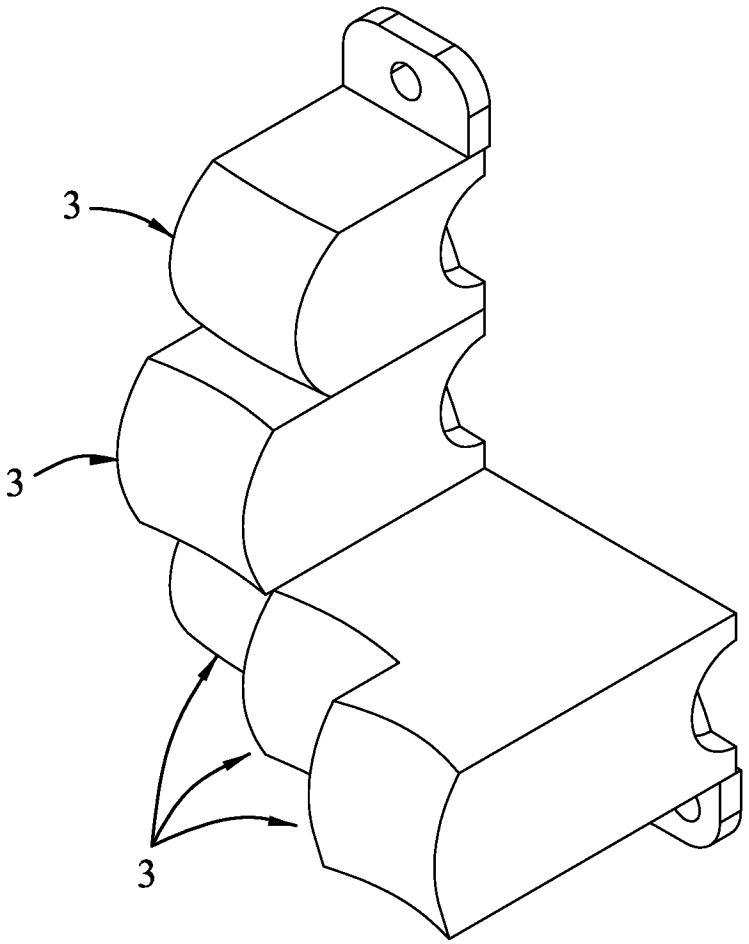
FIG. 11 is a front perspective view of a vehicle light assembly according to a fourth embodiment of the present disclosure.

Referring to FIG. 11, a vehicle light assembly according to a fourth embodiment of the present disclosure includes a plurality of the light emitter modules 3 are integrally interconnected and arranged to have an L-shaped configuration.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A vehicle light assembly comprising:

at least one light emitter module including a lens and a light emitter disposed at a rear side of said lens, said lens including a curved light exit surface disposed at a front side of said lens, a light entry surface spaced apart from said light exit surface along an optical axis, and disposed adjacent to said light emitter, said light entry surface having a first light entry portion through which the optical axis passes, said first light entry portion being convexed rearwardly in a direction away from said curved light exit surface, left and right reflection surfaces respectively connected to left and right sides of said light entry surface to reflect light of said light emitter passing through said light entry surface to said curved light exit surface, each of said left and right reflection surfaces being a parabolic surface and having a virtual focal point that is disposed at a distance from said light entry surface more longer than a distance of said light emitter from said light entry surface, the virtual focal point being offset from the optical axis, and left and right flank surfaces respectively disposed at a left side of said left reflection surface and a right side of said right reflection surface and extending forwardly to connect to said curved light exit surface, an entire length of each of said left and right flank surfaces having a distance from the optical axis, each of said left and right reflection surfaces having a maximum distance from the optical axis, the distance of each of said left and right flank surfaces from the optical axis being greater than the maximum distance of each of said left and right reflection surfaces from the optical axis.

2. The vehicle light assembly as claimed in claim 1, wherein said light entry surface further has a base portion and a second light entry portion, said base portion disposed around the optical axis rearwardly of said first light entry portion, said second light entry portion being disposed annularly around the optical axis and connected between an annular inner periphery of said base portion and said first light entry portion, said first and second light entry portions cooperatively bounding a light entry hole.

3. The vehicle light assembly as claimed in claim 1, wherein said curved light exit surface has an exit surface top side, an exit surface bottom side, an exit surface left side, and an exit surface right side, said curved light exit surface protruding arcuately and forwardly from said exit surface top and bottom sides to a region located midway between said exit surface top and bottom sides.

4. The vehicle light assembly as claimed in claim 3, wherein said curved light exit surface indents rearwardly and arcuately from said exit surface left and right sides to a region located midway between said exit surface left and right sides.

5. The vehicle light assembly as claimed in claim 1, wherein said light emitter has a center located at the optical axis, said at least one light emitter module functioning as a high beam light bulb.

6. The vehicle light assembly as claimed in claim 1, wherein said light emitter has an edge located at the optical axis, said at least one light emitter module functioning as a low beam light bulb.

7. The vehicle light assembly as claimed in claim 1, wherein said at least one light emitter module includes a plurality of light emitter modules juxtaposed to each other, one of said left and right flank surfaces of each of said light emitter modules facing one of left and right said flank surfaces of the other one of said light emitter modules.

8. The vehicle light assembly as claimed in claim 1, wherein said at least one light emitter module includes a plurality of light emitter modules juxtaposed to each other, at least one of said light emitter modules functioning as a high beam light bulb, at least one of said light emitter modules functioning as a low beam light bulb.

9. The vehicle light assembly as claimed in claim 1, wherein said at least one light emitter module includes a plurality of light emitter modules juxtaposed to each other, all of which function as high or low beam light bulbs.

10. A vehicle light assembly comprising:

at least one light emitter module including a lens and a light emitter disposed at a rear side of said lens, said lens including a curved light exit surface disposed at a front side of said lens, a light entry surface spaced apart from said light exit surface along an optical axis, and disposed adjacent to said light emitter, said light entry surface having a light entry hole immediately disposed at a front of said light emitter, and a first light entry portion immediately disposed at a front of said light entry hole, the optical axis passing through said light entry hole and said first light entry portion, said first light entry portion being convexed rearwardly into said light entry hole, left and right reflection surfaces respectively connected to left and right sides of said light entry surface to reflect light of said light emitter passing through said light entry surface to said curved light exit surface, each of said left and right reflection surfaces being a parabolic surface and having a virtual focal point that is disposed at a distance from said entry surface longer than a distance of said light emitter from said light entry surface, the virtual focal point being offset from the optical axis, and left and right flank surfaces respectively disposed at a left side of said left reflection surface and a right side of said right reflection surface and extending forwardly to connect to said curved light exit surface, an entire length of each of said left and right flank surfaces having a distance from the optical axis, each of said left and right reflection surfaces having a maximum distance from the optical axis, the distance of each of said left and right flank surfaces being greater than the maximum distance of each of said left and right reflection surfaces.

11. The vehicle light assembly as claimed in claim 1, wherein said light entry surface further has a base portion and a second light entry portion, said base portion disposed around the optical axis rearwardly of said first light entry portion, said second light entry portion disposed annularly around the optical axis and connected between an annular inner periphery of said base portion and said first light entry portion, said first and second light entry portions cooperatively bounding said light entry hole, said light entry hole having an opening formed in said base portion, said left and right reflection surfaces being connected to left and right sides of said base portion, said base portion being close to said light emitter.

* * * * *